US010178935B2

(12) United States Patent
Morgan

(10) Patent No.: US 10,178,935 B2
(45) Date of Patent: Jan. 15, 2019

(54) SCALING REDUCTION IN A BOILER USED IN A SURFACE CLEANING APPARATUS

(71) Applicant: Techtronic Floor Care Technology Limited, Nashville, TN (US)

(72) Inventor: Charles J. Morgan, Sparta, TN (US)

(73) Assignee: Techtronic Floor Care Technology Limited, Tortola (VG)

( * ) Notice: Subject to any disclaimer, the term of this patent is extended or adjusted under 35 U.S.C. 154(b) by 152 days.

(21) Appl. No.: 14/962,430

(22) Filed: Dec. 8, 2015

(65) Prior Publication Data

US 2016/0095490 A1 Apr. 7, 2016

Related U.S. Application Data

(63) Continuation of application No. 13/302,275, filed on Nov. 22, 2011, now Pat. No. 9,233,402.

(51) Int. Cl.

| | |
|---|---|
| ***B08B 3/00*** | (2006.01) |
| ***F22B 1/28*** | (2006.01) |
| ***A47L 11/40*** | (2006.01) |
| ***A47L 13/22*** | (2006.01) |

(52) U.S. Cl.

CPC ..... *A47L 11/4086* (2013.01); *A47L 11/4011* (2013.01); *A47L 11/4013* (2013.01); *A47L 13/225* (2013.01); *B08B 3/00* (2013.01); *F22B 1/282* (2013.01); *B08B 2230/01* (2013.01)

(58) Field of Classification Search

CPC ..... A47L 11/4086; A47L 13/225

See application file for complete search history.

(56) References Cited

U.S. PATENT DOCUMENTS

| | | | | |
|---|---|---|---|---|
| 5,492,169 | A | 2/1996 | Valadon | |
| 5,819,352 | A * | 10/1998 | Bancroft | A47L 11/24 15/368 |
| 6,647,204 | B1 | 11/2003 | Hutchinson | |
| 2005/0066467 | A1 | 3/2005 | Moshenrose | |
| 2007/0130722 | A1 | 6/2007 | Chung et al. | |
| 2008/0189992 | A1 | 8/2008 | Valiyambath Krishnan et al. | |

(Continued)

FOREIGN PATENT DOCUMENTS

| | | |
|---|---|---|
| CN | 2782238 Y | 5/2006 |
| CN | 2898606 | 5/2007 |

(Continued)

OTHER PUBLICATIONS

Chinese Patent Office Action for Application No. 201210489572.1 dated Dec. 24, 2015 (12 pages English translation only).

(Continued)

*Primary Examiner* — Spencer E Bell
(74) *Attorney, Agent, or Firm* — Michael Best & Friedrich LLP

(57) ABSTRACT

A steam generator for a surface cleaning apparatus is described. The steam generator includes: a first chamber for generating steam and collecting scale; a water inlet disposed proximate a first end of the first chamber; a heater in thermal contact with the first chamber; a second chamber housed within the first chamber and in fluid communication with the first chamber; and a steam outlet for releasing steam and in fluid communication with the second chamber, wherein the steam outlet is disposed distal to the first end of the first chamber.

20 Claims, 3 Drawing Sheets

(56) References Cited

U.S. PATENT DOCUMENTS

| | | | | |
|---|---|---|---|---|
| 2011/0107533 | A1* | 5/2011 | Haan | A47L 11/33 15/41.1 |
| 2013/0125940 | A1 | 5/2013 | Morgan | |

FOREIGN PATENT DOCUMENTS

| | | | |
|---|---|---|---|
| CN | 201314544 | | 9/2009 |
| CN | 201396738 | Y | 2/2010 |
| CN | 201652312 | U | 11/2010 |
| CN | 101907287 | A | 12/2010 |

OTHER PUBLICATIONS

Chinese Patent Office Action and Search Report for Application No. 201610801335.2 dated Feb. 28, 2018 (7 pages, English translation included).

* cited by examiner

SCALING REDUCTION IN A BOILER USED IN A SURFACE CLEANING APPARATUS

TECHNICAL FIELD

The present teachings are directed toward the improved cleaning and durability capabilities of steam generating surface cleaners.

BACKGROUND

A need has been recognized in the surface cleaning industry for steam generating surface cleaner that has increased longevity. A requirement for many steam generating appliances is the use of distilled water in order to prevent scale buildup within a boiler. Prior art boilers and steam generators have a single internal chamber for generating steam. Distilled water is free of any contaminates or particulates, and thus does not produce scale within the boiler. Failure to use distilled water in prior art boilers produces scale within the boiler, eventually leading to clogged outlets, and reduced efficiency and performance. Because a consumer must purchase and store distilled water in order to properly utilize a steam generating vacuum cleaner, such units have increased expense and inconvenience associated with their use. As such, there exists a need for a steam generating surface cleaner that can reduce scale buildup thereby increasing the longevity of the steam cleaning appliance while reducing the operational costs associated with use of the surface cleaner.

Other deficiencies in the prior art can be inferred by the disclosure herein.

SUMMARY

According to one embodiment, a steam generator for a surface cleaning apparatus is described. In some embodiments, the steam generator comprises a first chamber for generating steam and collecting scale, a water inlet disposed proximate a first end of the first chamber, a second chamber housed within the first chamber and in fluid communication with the first chamber, and a steam outlet for releasing steam and in fluid communication with the second chamber, wherein the steam outlet is disposed distal to the first end of the first chamber.

In some embodiments, the water inlet is substantially orthogonal to the first chamber. In some embodiments, the first chamber is substantially cylindrical in shape. In some embodiments, the second chamber is substantially cylindrical in shape. In some embodiments, the first chamber comprises a non-corrosive heat conductor. In some embodiments, the second chamber comprises a non-corrosive heat conductor.

In some embodiments, the steam generator further comprises a heating element disposed in contact with the first chamber. In some embodiments, the steam generator further comprises a temperature sensor to sense the operating temperature of the first chamber, wherein power is removed from the heating element when the operating temperature exceeds a threshold.

In some embodiments, the steam generator further comprises a water pump, and a temperature sensor to sense the operating temperature of the first chamber, wherein power is supplied to the water pump when the operating temperature exceeds a threshold.

In some embodiments, the steam generator further comprises a thermal insulator disposed around the first chamber.

According to various embodiments, a steam generator for a surface cleaning apparatus is described. In some embodiments, the steam generator comprises a first chamber for generating steam and collecting scale, a water inlet disposed proximate a first end of the first chamber, and a conduit disposed within the first chamber and including a steam inlet disposed proximate a first end of the conduit, and a steam outlet disposed proximate a second end distal from the first end, wherein the steam outlet is disposed outside the first chamber, and the first end of the conduit is disposed proximate the water inlet.

In some embodiments, the steam generator is disposed vertical to a cleaning surface. In some embodiments, the multi-chamber steam generator is horizontal to a cleaning surface. In some embodiments, the multi-chamber steam generator further comprises a water inlet and a steam outlet. In some embodiments, the steam generator further comprises a water pump, wherein a water pump outlet of the water pump is fluidly connected to a water inlet of the multi-chamber steam generator.

In some embodiments, the water pump outlet is vertically below the water inlet. In some embodiments, the cleaning apparatus further comprises a water reservoir. In some embodiments, the water reservoir is vertically above the water pump. In some embodiments, the pump is a self-priming pump. In some embodiments, the pump is a metered pump. In some embodiments, the surface cleaning apparatus further comprises a beater bar housing, a beater bar for agitating a cleaning surface, and a debris collection unit for collecting debris from the cleaning surface, wherein the debris collection unit is fluidly connected to the beater bar housing.

In some embodiments, the beater bar is driven by a motor. In some embodiments, the surface cleaning apparatus further comprises wheels, wherein the beater bar is driven by the frictional force of the wheels on the cleaning surface. In some embodiments, the surface cleaning apparatus further comprises a temperature sensor. In some embodiments, the temperature sensor turns on a pump when a minimum temperature within the multi-chamber steam generator is reached. In some embodiments, the temperature sensor shuts of power to a heating element when a maximum temperature within the multi-chamber steam generator is reached.

BRIEF DESCRIPTION OF THE DRAWINGS

The same reference number represents the same element on all drawings. It should be noted that the drawings are not necessarily to scale. The foregoing and other objects, aspects, and advantages are better understood from the following detailed description of a preferred embodiment of the invention with reference to the drawings, in which.

DETAILED DESCRIPTION

The present teachings provide a steam generator for a surface cleaner capable of providing improved cleaning features and longevity. The structure of a steam generator can comprise an inlet, a body with an internal chamber, and an outlet. A second chamber, housed within the first chamber, prevents the accumulation of scale within the outlet, thereby increasing the longevity of the steam cleaner, reducing costs associated with use and maintenance for a consumer.

Figure 1:
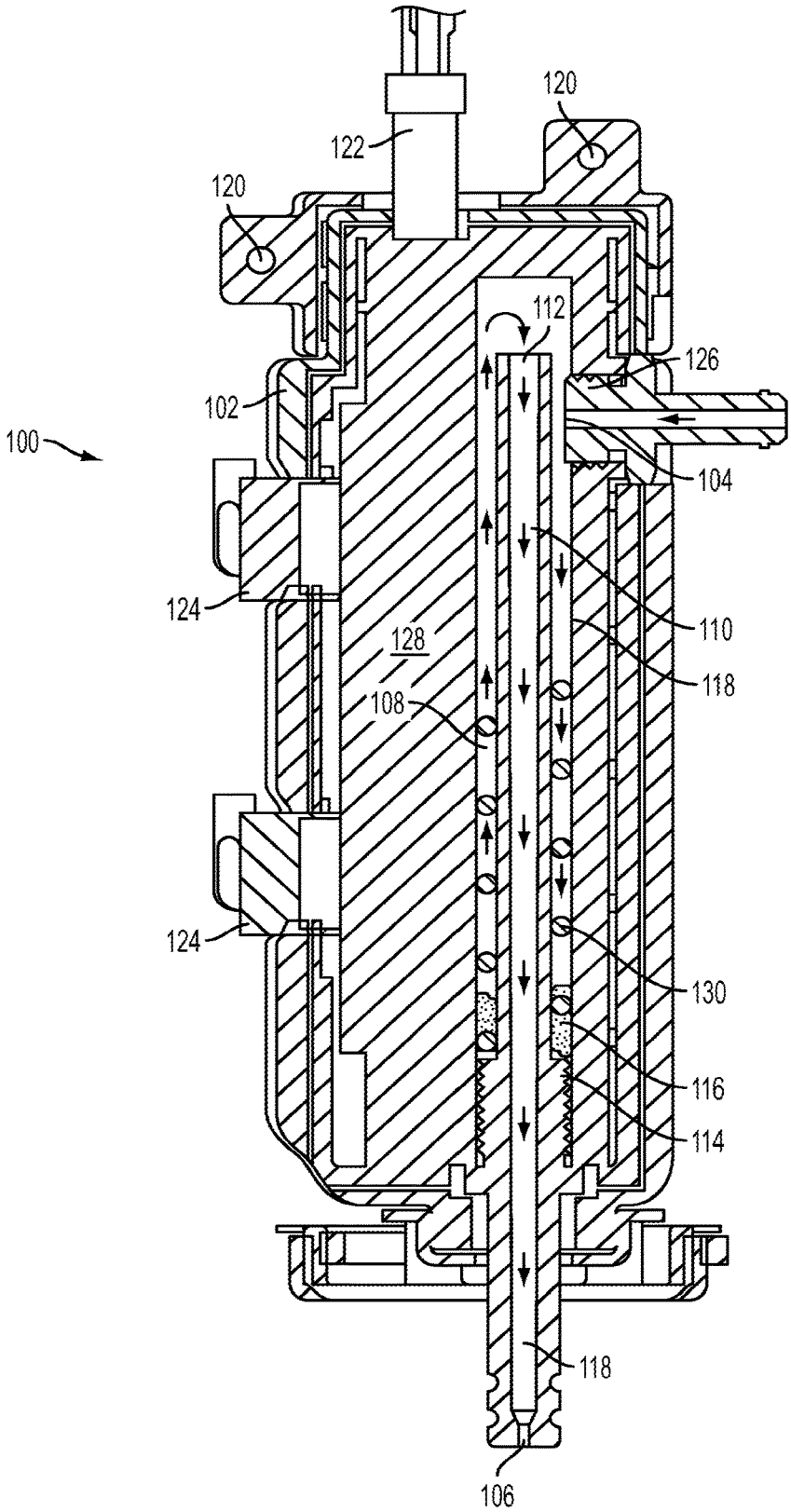
FIG. 1 illustrates a cross section of one embodiment of a steam generator.

FIG. 1 illustrates an exemplary embodiment of a steam generator 100. A steam generator housing 102 may contain a first chamber 108 and a second chamber 110. Water may flow into steam generator 100 via water inlet 104, where the water flows into first chamber 108 and is heated into steam. As the steam rises within chamber 108, pressure builds in chamber 108. Eventually the steam is forced into second chamber 110 at second chamber steam inlet 112. Steam may exit steam generator 100 by passing through second chamber outlet passage 118. Second chamber outlet passage 118 can include a tip that is narrow in diameter at outlet 106. During the evaporation of water into steam within first chamber 108, any contaminants, particulates, or mineral deposits may be released from the water to form a scale 116. The scale 116 falls out of the water and may accumulate at the bottom and along the side walls of first chamber 108. Thus, steam, free from any contaminants, enter second chamber steam inlet 112 and exits outlet 106. As such, the scale 116 is generally disposed off in chamber 108 and scale 116 does not clog outlet 106. Contaminant free steam may be delivered to a mop head or a steam nozzle where it can used to clean a surface of interest. In some embodiments, the mass or surface area of a heated surface can be increased within first chamber 108. This can be accomplished by disposing a spring 130 around second chamber 110, or by disposing other non-corrosive heat conductive materials shaped as spheres, rings, powders etc. within first chamber 108. The increased surfaces, thereby allowing more efficient steam generation and increasing the efficiency of the removal of contaminants from the water.

Water, flowing into steam generator 100, may be transformed into steam by heat generated by heater 122 embedded within a heater block 128. Electrical power may be supplied to heater 122. In some embodiments, heater 122 may include a resistance heating element, such as a wire, coil, ribbon, screen, foil, heat lamp or ceramic element. The heating element may comprise kanthal, nichrome, cupronickel, molybdenum dicilide, ceramic insulated metal, of PTC ceramic, or mixtures thereof.

Temperature sensors 124 may detect temperatures of first chamber 108 and second chamber 110. Temperature sensors 124 may be connected to a monitoring circuit (not shown) such that if an internal temperature of first chamber 108 and/or second chamber 110 is exceeded, power to a heater, pump, or other component of surface cleaner is turned off. In some embodiments, temperature sensors 124 may be connected to a monitoring circuit (not shown) such that if a minimum temperature is reached, power to a pump, beater bar, or other component of the surface cleaner is turned on. Temperature sensors 124 can be in thermal contact with heater block 128.

Housing 102 may be a single integrated unit or may contain multiple parts pieced together to form housing 102. For example, housing 102 may include an inlet receiving portion to receive threads 126 on inlet 104. As such, a conduit, for example, from a water reservoir, can be secured to inlet 104. In some embodiments, outlet 106 may include threads 114 which allows second chamber 110 and second chamber outlet passage 118 to be secured into housing 102 within first chamber 108. In some embodiments, housing 102 may comprise two halves. The two halves may be secured together via fasteners (not shown) which may be received in fastener receivers 120. In some embodiments, fastener receivers 120 receive fasteners which secure steam generator into a surface cleaner. In some embodiments, the whole unit may be die cast. In some embodiments, housing 102 comprises a heat conducting material. For example, in some embodiments, housing 102 can comprise aluminum, steel, or other suitable materials, or combinations thereof.

In some embodiments, first chamber 108 and second chamber 110 comprise heat conductive material that is resistant to rust. In some embodiments, first chamber 108 and second chamber 110 are made from the same materials. In some embodiments, first chamber 108 is a different material than second chamber 110. In some embodiments, first chamber 108 and/or second chamber 110 comprise brass, copper, stainless steel, polytetrafluoroethylene (i.e., Teflon), or other suitable materials, and mixtures thereof. In a preferred embodiment, second chamber 110 comprises Teflon.

Figure 2:
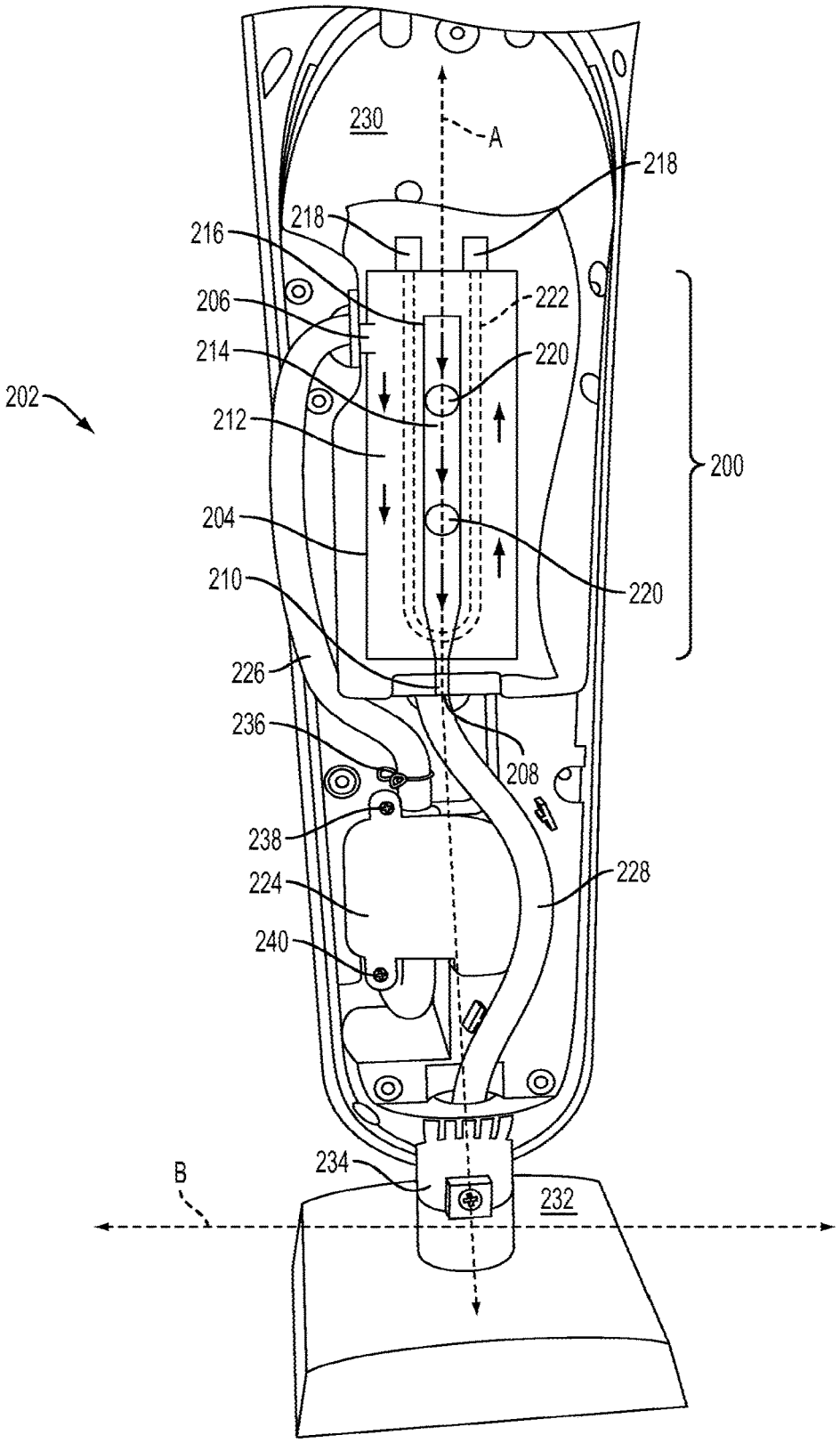
FIG. 2 illustrates the interior of the body of an upright vacuum cleaner having a steam generator according to one embodiment.

FIG. 2 illustrates an embodiment of a steam generator in a surface cleaner. In this embodiment, steam generator 200 is secured within the body portion of an upright floor cleaner 202. A water reservoir (not shown) supplies water to a pump 224. Hose 226 may allow water to travel from pump to steam generator inlet 206. Water enters first chamber 212, where the water becomes steam, the steam travels to second chamber steam inlet 216. Steam then travels through second chamber 214, through second chamber outlet passage 210, and out of steam generator 200 via outlet 208. Hose 228 conducts steam from steam generator to a steam applicator, for example, a cloth mop or a nozzle. Hose 228 and/or hose 226 may be secured to various inlets or outlets via locking pins 236 or other fasteners as known in the art.

Water, flowing into steam generator 200, may be transformed into steam by heat generated by heating elements 222 embedded within steam generator interior portion. Power may be supplied to heating elements 222 via connectors 218. In some embodiments, heating elements 222 may include a resistance heating element, such as a wire, coil, ribbon, screen, foil, heat lamp, or ceramic element. The heating elements 222 may comprise kanthal, nichrome, cupronickel, molybdenum dicilide, ceramic insulated metal, of PTC ceramic, or mixtures thereof.

Temperature sensors 220 may detect temperatures of first chamber 212 and second chamber 214. Temperature sensors 220 may be connected to a monitoring circuit (not shown) such that if an internal temperature of first chamber 212 and/or second chamber 214 is exceeded, power to heating element 222 is turned off. In some embodiments, temperature sensors 220 may be connected to a monitoring circuit (not shown) such that if a minimum temperature is reached, power to pump 224 is turned on.

In this embodiment, steam generator 200 is located within a floor surface cleaning machine 202. Floor surface cleaning machine 202 may have a surface cleaner housing and a base portion 232 which are connected at pivot point 234. Although not shown, floor surface cleaning machine may include a handle, power cords, circuit boards, a water reservoir, motors, dust collecting chambers (or bags), beater bars, brushes, hand held attachments, etc. In some embodiments, floor surface cleaning machine utilized removable cloth pads to clean the surface.

In this embodiment, pump 224 is located below steam generator 200 along axis A. In some embodiments, pump 224 is located below a water reservoir. In such embodiments, gravity may prime pump 224 with water from the water reservoir. In some embodiments, pump 224 is a self priming pump. In some embodiments, pump 224 is a metered pump. In some embodiments, first chamber 212 and/or second chamber 214 of steam generator 200 are disposed along axis A. As such, first chamber 212 and/or second chamber 214 of steam generator 200 are substantially orthogonal to the surface to be cleaned as depicted by axis B.

Figure 3:
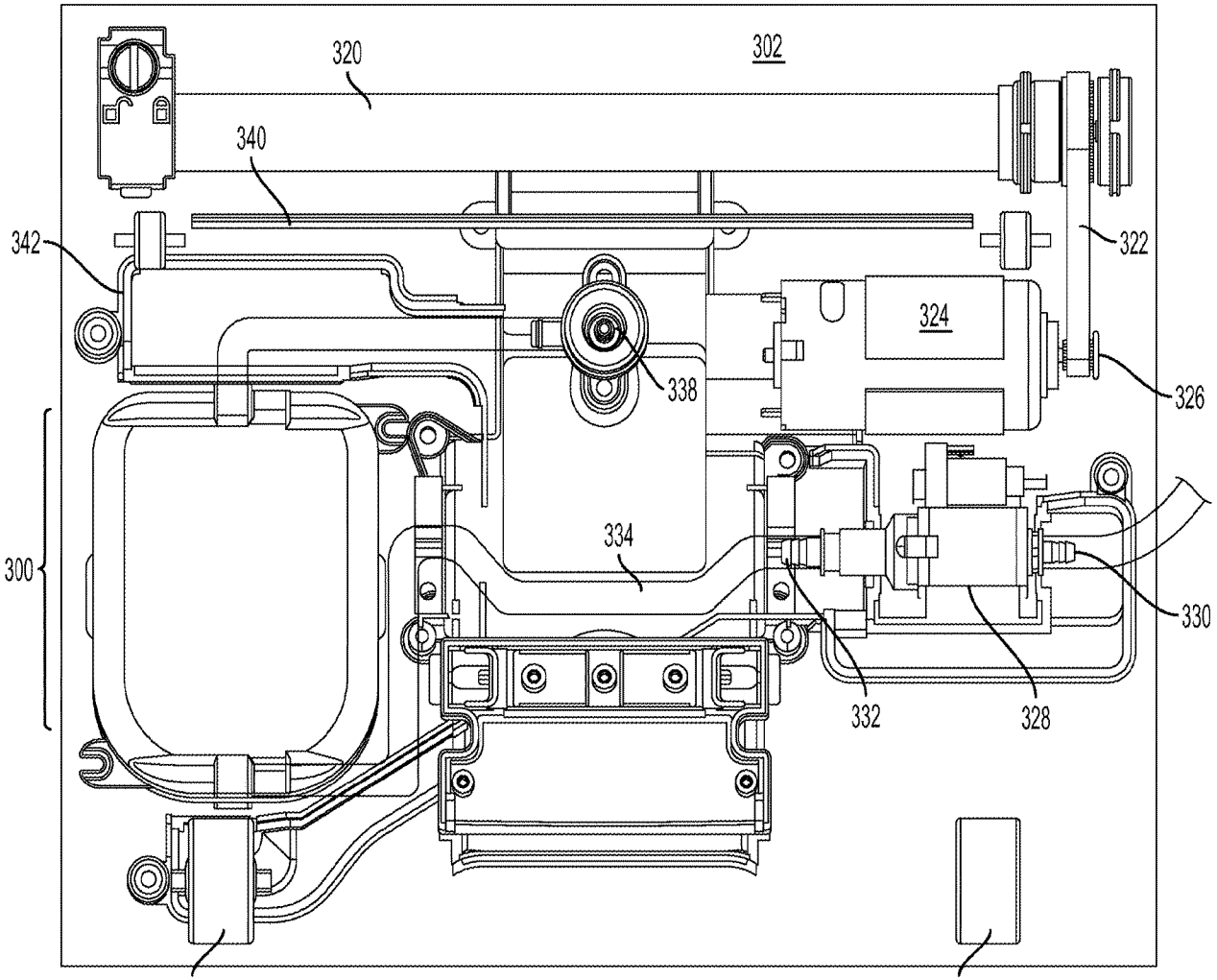
FIG. 3 illustrates the interior of the base of an upright vacuum cleaner having a steam generator according to one embodiment.

FIG. 3 illustrates steam generator 300 within the housing 342 of a floor cleaner base 302. In this embodiment, water flows from a water reservoir (not shown) and into pump inlet 330, through pump 328, through water hose 334, and into steam generator. Steam generated in steam generator 300 travels through a conduit and out of the floor cleaner base 302 at nipple 338. In some embodiments, floor cleaner base includes motor assembly 324 and motor shaft 326, which drives beater bar 320 via flexible belt 322. In some embodiments, floor cleaner base 302 includes wheels 336. For example, in some embodiments, the floor cleaner includes a beater bar housing, beater bar 320 for agitating a cleaning surface, and a debris collection unit for collecting debris from the cleaning surface, wherein the debris collection unit is fluidly connected to the beater bar housing.

In some embodiments, the steam generators are in any shape suitable for generating steam. In some embodiments, the steam generator may be substantially cylindrical, cuboidal, conical, rectangular, or spherical in shape. In some embodiments, the first chamber is substantially the same shape as the second chamber. In some embodiments, the first chamber has a different shape than the second chamber. For example, the first chamber may be substantially conical while the second chamber is substantially cylindrical in shape.

Combinations of different features illustratively described in connection with the embodiments are also contemplated. Although the embodiments illustrated herein relate steam generators in a floor cleaner, alternative surface cleaner configurations (e.g., hand held, canister, etc.) are also contemplated.

The various embodiments described above are provided by way of illustration only and should not be constructed to limit the invention. Those skilled in the art will readily recognize the various modifications and changes which may be made to the present invention without strictly following the exemplary embodiments illustrated and described herein, and without departing from the true spirit and scope of the present invention, which are set forth in the following claims.

What is claimed is:

1. A surface cleaning apparatus comprising:

a steam generator including, a first chamber for generating steam and collecting scale, the first chamber including a wall, a water inlet for providing fluid to the first chamber, a heater in thermal contact with the first chamber, a second chamber housed within the first chamber and in fluid communication with the first chamber, the second chamber including a wall at least partially defining the second chamber, the first chamber at least partially defined by the wall of the second chamber and the wall of the first chamber, a steam outlet for releasing steam and in fluid communication with the second chamber, a water reservoir in fluid communication with the water inlet, and a spring disposed within the first chamber between the wall of the first chamber and the wall of the second chamber.

2. The surface cleaning apparatus of claim 1, wherein the spring is in contact with the wall of the first chamber and the wall of the second chamber.

3. The surface cleaning apparatus of claim 1, wherein at least one of a mass and a surface area of a heated surface is increased within the first chamber by the spring.

4. The surface cleaning apparatus of claim 1, wherein the wall of the first chamber and the wall of the second chamber are parallel.

5. The surface cleaning apparatus of claim 1, wherein the spring is a helical spring.

6. The surface cleaning apparatus of claim 1, wherein the spring includes a heat conductive material.

7. The surface cleaning apparatus of claim 1, wherein the spring includes a series of rings disposed in the first chamber.

8. The surface cleaning apparatus of claim 1, wherein the water inlet is disposed proximate a first end of the first chamber.

9. The surface cleaning apparatus of claim 8, wherein the steam outlet is disposed distal to the first end of the first chamber.

10. The surface cleaning apparatus of claim 1, further comprising a temperature sensor in thermal contact with the steam generator, wherein the temperature sensor enables water flow to the steam generator when a minimum temperature within the steam generator is reached.

11. The surface cleaning apparatus of claim 1, further comprising a temperature sensor in thermal contact with the steam generator, wherein the temperature sensor shuts off power to the heater when a maximum temperature within the steam generator is reached.

12. The surface cleaning apparatus of claim 1, further comprising a steam inlet of the second chamber disposed above the water inlet of the steam generator when the steam generator is disposed in the surface cleaning apparatus.

13. The surface cleaning apparatus of claim 12, wherein the water entering from the water inlet into the first chamber flows away from the steam inlet.

14. The surface cleaning apparatus of claim 12, wherein the steam outlet is disposed outside the first chamber and the steam inlet is disposed proximate the water inlet.

15. The surface cleaning apparatus of claim 1, wherein the water inlet is substantially orthogonal to the first chamber.

16. The surface cleaning apparatus of claim 1, further comprising a thermal insulator disposed around the first chamber.

17. The surface cleaning apparatus of claim 1, wherein the first chamber is substantially cylindrical in shape.

18. The surface cleaning apparatus of claim 17, wherein the second chamber is substantially cylindrical in shape.

19. The surface cleaning apparatus of claim 1, wherein the first chamber comprises a non-corrosive heat conductor.

20. The surface cleaning apparatus of claim 1, wherein the second chamber comprises a non-corrosive heat conductor.

* * * * *